United States Patent [19]

Rosenthal

[11] Patent Number: 4,915,827

[45] Date of Patent: Apr. 10, 1990

[54] METHOD AND APPARATUS FOR OPTICAL SORTING OF MATERIALS USING NEAR INFRARED ABSORBTION CRITERIA

[75] Inventor: Robert D. Rosenthal, Gaithersburg, Md.

[73] Assignee: Trebor Industries, Inc., Gaithersburg, Md.

[21] Appl. No.: 195,796

[22] Filed: May 19, 1988

[51] Int. Cl.[4] ..... B07C 5/342

[52] U.S. Cl. ..... 209/577; 250/339; 250/341

[58] Field of Search ..... 209/555, 556, 558, 576, 209/577, 579, 587, 588, 656, 657; 250/339, 341; 364/498

[56] References Cited

U.S. PATENT DOCUMENTS

| | | | |
|---|---|---|---|
| 3,747,755 | 7/1973 | Senturia et al. | 209/577 X |
| 4,166,540 | 9/1979 | Marshall | 209/555 |
| 4,236,640 | 12/1980 | Knight | 209/588 X |
| 4,286,327 | 8/1981 | Rosenthal et al. | 250/339 X |
| 4,466,076 | 8/1984 | Rosenthal . | |
| 4,627,008 | 12/1986 | Rosenthal . | |

FOREIGN PATENT DOCUMENTS

| | | | |
|---|---|---|---|
| 0064842 | 11/1982 | European Pat. Off. | 209/577 |
| 0247016 | 11/1987 | European Pat. Off. | 209/587 |
| 2230724 | 9/1973 | Fed. Rep. of Germany | 209/577 |
| 2430272 | 2/1980 | France | 209/587 |
| 0925426 | 5/1982 | U.S.S.R. | 209/606 |
| 2172699 | 9/1986 | United Kingdom | 250/339 |

*Primary Examiner*—Margaret A. Focarino
*Assistant Examiner*—Edward M. Wacyra
*Attorney, Agent, or Firm*—Bernard, Rothwell & Brown

[57] ABSTRACT

Method and apparatus for sorting desired pieces of material from undesired material present in mixtures thereof. A piece of material from a mixture of pieces of desired and undesired materials is irradiated with a plurality of wavelengths of near-infrared radiation. The absorptions by the irradiated piece of near-infrared radiation energy is measured at a plurality of wavelengths. The measured absorptions are sequentially compared to a successive series of predetermined different absorption criteria in a predetermined order, which criteria distinguish the desired material from undesired material. If the piece fails any one criterion, it is rejected, whereas if the piece passes all criteria, it is accepted as a desired piece.

7 Claims, 2 Drawing Sheets

METHOD AND APPARATUS FOR OPTICAL SORTING OF MATERIALS USING NEAR INFRARED ABSORBTION CRITERIA

BACKGROUND OF THE INVENTION

1. Field of the Invention

The present invention relates to the field of optical sorting of desirable materials from mixtures that also contain undesirable materials.

2. Description of the Background Art

The harvesting and gathering of agricultural products into bulk accumulations on a commercial scale usually results in a certain percentage of undesirable materials intermixed with the desired agricultural product. The undesired material may include trash, debris, diseased product, and the like. Machines of varying effectiveness are known in the prior art for sorting the desired product from the undesirable material. In providing a sorting device, the goal is to eliminate as much of the undesirable material as possible with as little human labor and waste of desired product as possible.

The prior art contains a number of apparatus and processes for measuring constituents of samples, such as grains, for moisture, protein and oil content utilizing near-infrared radiation energy. For example, U.S. Pat. Nos. 4,466,076 and 4,627,008, both to Robert D. Rosenthal, the inventor of the present invention, disclose instruments that can measure constituents of a sample by transmitting near-infrared radiation energy through the sample. These instruments utilize a phenomenon that certain organic substances absorb energy in the near-infrared region of the spectrum. By measuring the amount of energy absorbed by the substances at specific wavelengths, precise quantitative measurements of the constituents of a produce can be determined. While such instruments have proven extremely useful for measuring one or more constituents of a particular sample, near-infrared light transmittance technology has not heretofore been suggested as suitable for separating desirable materials from mixtures that also contain undesirable materials.

SUMMARY OF THE INVENTION

The present invention provides a method and apparatus for sorting desirable pieces of material from undesirable materials present in mixtures of desirable and undesirable materials. In accordance with the invention, a piece of material from a mixture of pieces of desirable and undesirable materials is irradiated with a plurality of wavelengths of near-infrared radiation. Absorption by the piece of a plurality of wavelengths of near-infrared radiation is measured, and the measured absorptions are sequentially compared to a successive series of predetermined different absorption criteria, in a predetermined order. The criteria distinguish the desirable material from the undesirable material. If the piece fails any one criteria in the sequence, it is rejected. If, however, the piece passes all criteria in the sequence, it is accepted.

DETAILED DESCRIPTION OF THE PREFERRED EMBODIMENT

The present invention is useful for sorting of commodities, such as almonds, green beans and the like, that after harvesting the gathering in bulk contain a certain percentage of contaminants such as trash, debris, and diseased or insect-damaged product.

Figure 1:
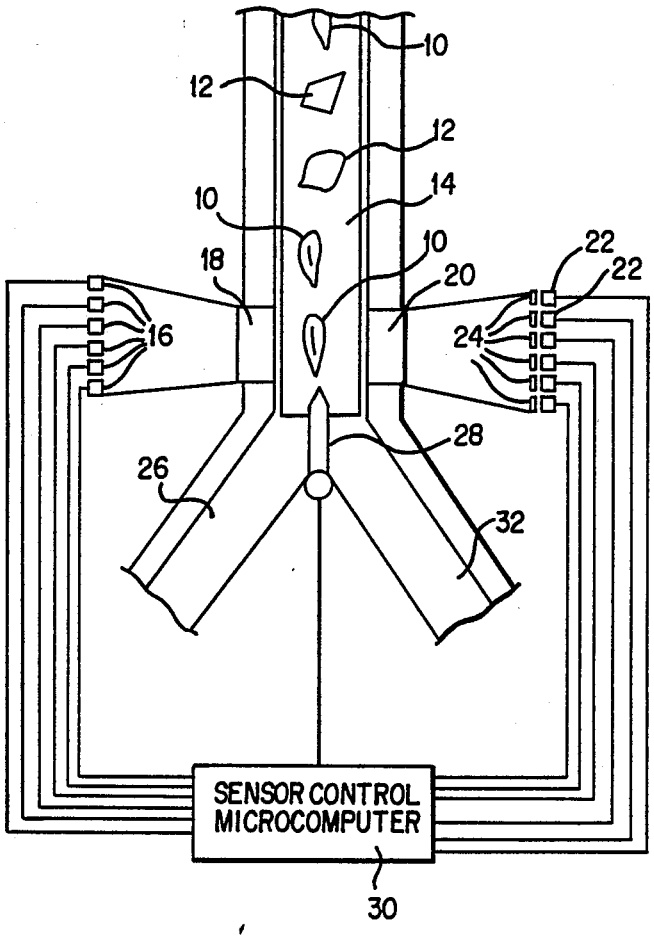
FIG. 1 is a schematic illustration of an apparatus for performing the method of the present invention.

In FIG. 1, a mixture of desirable materials such as almonds 10 and undesirable materials 12, such as almond by-products, trash, debris and insect damaged or diseased almonds, are singulated (i.e., arranged in single file) on a suitable conveying means 14 for placing the pieces in position for near-infrared analysis. A plurality of infrared emitting diodes (IREDs) 16 are positioned for irradiating the pieces of material with near-infrared radiation through a near-infrared-transparent window 18 as each piece of material is positioned in front of window 18. Each piece of material is irradiated with a plurality of wavelengths of near-infrared radiation from the IREDs. The near-infrared radiation wavelength range is from about 740 to about 1100 nanometers. In the illustrated embodiment, each piece is simultaneously irradiated at each of the preselected wavelengths by the IREDs 16.

The near-infrared radiation emitted from IREDs 16 impinges on the sample piece being analyzed, and a certain portion of the energy is transmitted through the sample while some of the energy is absorbed by the sample. Energy that is transmitted through the sample passes through near-infrared transparent window 20 and is measured by near-infrared radiation detectors 22 at a plurality of wavelengths. Each detector 22 is provided with a narrow bandpass filter 24 that allows energy of the particular wavelength being measured to pass through the respective detector.

The absorption of particular wavelengths measured by detectors 22 is sequentially compared to a successive series of predetermined different absorption criteria in a predetermined order by sensor-control/microcomputer 30. The particular criteria selected distinguish the desirable material from undesirable material. The particular criteria selected will depend upon the material being sorted. Also, the sequence that the measured absorptions are compared to the different criteria can vary, depending upon the material being sorted.

In accordance with the present invention, an internal microprocessing unit in the sensor-control/microcomputer sorting system 30 controls IREDs 16 and detectors 22 for measuring each sample as it is passed by detectors 22. The microprocessor automatically compares the absorption measurements to a successive series of different criteria. If the sample fails the first criterion, it is automatically rejected, for example, by being diverted along pathway 26 by gate 28, as shown schematically in FIG. 1. However, if the sample passes the first criterion, it is then tested for a second criterion, and so on.

Figure 2:
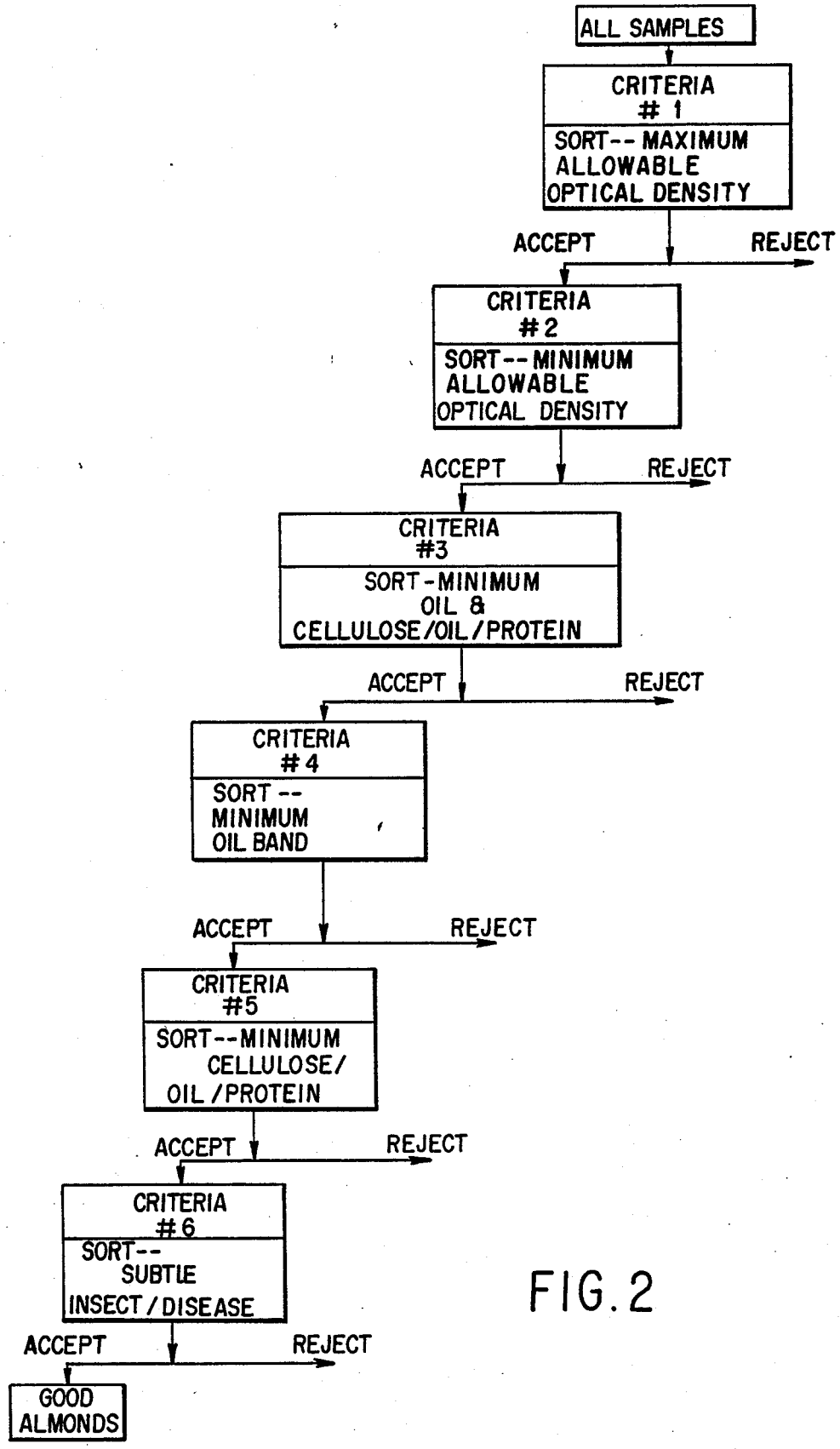
FIG. 2 is a flow chart for sorting of almonds via successive criteria in accordance with the present invention.

FIG. 2 shows a flow chart for sorting almonds via successive criteria. The first criterion that is compared is optical density (opacity) of a sample at 700 nanometers. Optical density is defined as Log 1/I where I is interactance and equal to $E_s/E_r$ ($E_s$=energy received from subject; $E_r$=energy received from a reference). For almonds, the maximum optical density (LOG 1/I) selected is 5.92. If a sample has an optical density in excess of the maximum allowed, it is immediately rejected without testing for subsequent criteria.

For sorting almonds, a second useful criterion is optical transparency of the sample at 700 nanometers. For almonds, a selected minimum optical transparency measured as Log 1/I is 4.25. Samples having an optical transparency of less than 4.25 are rejected, and not tested for any subsequent criteria. However, if the sample passes the second criterion, it is tested for a third criterion.

A useful third criterion for almonds is an oil plus oil/cellulose/protein absorption minimum. For this criterion, a multi-term regression is performed as follows: $10(OD_{928}-OD_{850})+10(OD_{1000}-OD_{950})$, wherein $OD_{928}$, $OD_{850}$, $OD_{1000}$ and $OD_{950}$ are optical density at 928 nanometers, 850 nanometers, 1,000 nanometers, and 950 nanometers, respectively. When storing almonds, all samples that are less than the value 1.27 for the above equation are rejected. Those samples that measured above 1.27 are tested for a fourth criterion.

Almonds have a relatively high oil content. Accordingly, absorption at the oil absorption band of 928 nanometers has been found to be a valuable fourth criterion when utilizing the equation: $10(OD_{928}-OD_{850})$, wherein $OD_{928}$ and $OD_{850}$ are optical densities at 928 and 850 nanometers, respectively. Samples having a value of less than 0.76 for the above equation are rejected, whereas those having a value of 0.76 or above are tested for the fifth criterion.

Cellulose absorption has been found to be a good fifth criterion for almonds sorting. For cellulose measurement, the following equation is used: $L=10(OD_{1000}-OD_{950})$, wherein $OD_{1000}$ and $OD_{950}$ are optical density at 1,000 and 950 nanometers, respectively. Samples having a value of 0.50 L or larger pass on to the sixth criterion, whereas samples that measure below that value are rejected.

A useful sixth criterion for almond sorting measures a subtle difference between good almonds and almonds damaged by insects or disease. This criterion was developed using wavelength calibration constants determined from stepwise regression of independent samples, and the following equation has been found to be useful:

$$Sort=-17.80-50.81\ OD_{750}+24.71\ OD_{800}+160.32\ OD_{825}-126.21\ OD_{875}$$

wherein $OD_{750}$, $OD_{800}$, $OD_{825}$, and $OD_{875}$ are optical density at 750, 800, 825 and 875 nanometers, respectively. Using a sorting threshhold value 4.0 and above for good almonds has been formed to results in a 100% rejection rate of almonds damaged by insects and disease, but also results in the rejection of approximately 4% of good almonds. If a lower sorting threshhold of 3.6 and above is utilized for good almonds, about 99% of almonds damaged by insects and disease are rejected, while only about 1% of acceptable almonds are wrongly rejected.

According to this embodiment, a sample that has passed all six criteria discussed above is accepted as a good almond and, in the schematic illustration of FIG. 1, is diverted along path 32 by diverter 28 under the control of the sensor-control/microcomputer 30.

The invention is further illustrated by the following example, which is not intended to be limiting.

EXAMPLE

A mixture of almonds and undesirable materials was sorted by sequentially comparing measured absorptions at a number of near-infrared wavelengths to a successive series of predetermined different absorption criteria according to the flow chart shown in FIG. 2. Each of the six criteria shown in FIG. 2 is described below, along with its success in rejecting various undesirable "trash" materials.

ALMOND SORTING CRITERIA
Criterion 1 - Elimination Of Samples That Are Too Opaque
Wavelength 700 nm used to set maximum limit
(Log 1/I = 5.92 was maximum allowed)

| Item | % Accepted (Passed to Criterion No. 2) | % Rejected |
|---|---|---|
| Good Almond | 100 | 0 |
| Pits | 0 | 100* |
| Gumballs | 88 | 12 |
| Mudballs | 1 | 99 |
| Clam Shells | 99 | 1 |
| Plastic and Rubber | 40 | 60 |
| Bone | 37 | 63 |
| Twigs | 22 | 78 |
| Pottery | 11 | 89 |
| Hull | 26 | 74 |
| Glass | 99 | 1 |
| Pee Wee's | 0 | 100* |
| Insect and Disease | 97 | 3 |
| Magnetic Metal | 0 | 100* |
| Non-magnetic Metal | 0 | 100* |

*Since 100% rejected, no need to test any further

Criterion No. 2 - Elimination Of Samples That Are Too Transparent
Wavelength 700 nm used to set minimum limit
(Log 1/T = 4.25 is minimum allowed)

| Item | % Accepted (Passed to Criterion No. 3) | % Rejected |
|---|---|---|
| Good Almonds | 100 | 0 |
| Gumballs | 88 | 12* |
| Mudballs | 1 | 99* |
| Clam Shells | 99 | 1* |
| Plastic and Rubber | 40 | 60* |
| Bone | 37 | 63* |
| Twigs | 11 | 89* |
| Pottery | 4 | 96** |
| Hulls | 26 | 74* |
| Glass | 1 | 99** |
| Insect and Disease | 54 | 46** |

*Criterion No. 2 did not help at all
**Remaining after Criteria 1 and 2

Criterion No. 3 - Oil Plus Oil/Cellulose/Protein Absorption Band Sorting
Multi-term regression performed of: 10 ($OD_{928}$-$OD_{850}$) + 10 ($OD_{1000}$-$OD_{950}$). All samples less than a minimum allowable value of 1.27 were rejected.

| Item | % Accepted (Passed to Criterion No. 4) | % Rejected |
|---|---|---|
| Good Almonds | 100 | 0 |
| Gumballs | 0 | 100** |
| Mudballs | 0 | 100** |
| Clam Shells | 0 | 100** |
| Plastics and Rubber | 1 | 99** |
| Bone | 0 | 100** |
| Twigs | 0 | 100** |
| Pottery | 1 | 99** |
| Hulls | 9 | 91** |
| Glass | 0 | 100** |
| Insect and Disease | 54 | 46* |

*Criterion No. 3 did not help
**Composite of Criteria Nos. 1, 2, and 3

Criterion No. 4 - Oil Absorption Band Sorting
Using only oil band; 10 ($OD_{928}$–$OD_{850}$)
Good almond is 0.76 L or higher

| Item | % Accepted (Passed to Criterion No. 5) | % Rejected |
|---|---|---|
| Good Almonds | 100 | 0 |
| Plastics and Rubber | 1 | 99* |
| Pottery | 0 | 100** |
| Hulls | 0 | 100** |
| Insect and Disease | 54 | 46* |

*Criterion No. 4 did not help
**Composite of Criteria Nos. 1, 2, 3 and 4

Criterion No. 5 - Cellulose Absorption Band
Using only cellulose band: L = 10 ($OD_{1000}$–$OD_{950}$)
(Good Almond is 0.50 L or larger)

| Item | % Accepted (Passed to Criterion No. 6) | % Rejected |
|---|---|---|
| Good Almonds | 100 | 0 |
| Plastics and Rubber | 0 | 100%* |
| Insects and Disease | 39 | 61%** |

**Composite of Criteria #1 through #5.

Criterion No. 6 - Subtle Insect/Disease Difference
Using wavelength calibration constants determined from stepwise regression of independent samples:

$$\text{Sort} = -17.80 - 50.81\,(\text{Log } 1/T)_{750} + 24.71\,(\text{Log } 1/I_{800} + 160.32\,(\text{Log } 1/I)_{825} - 126.21\,(\text{Log } 1/T)_{875}$$

| Item | % Accepted* | % Rejected* | % Accepted** | % Rejected** |
|---|---|---|---|---|
| Good Almonds | 96 | 4 | 99 | 1 |
| Insect and Disease | 0 | 100 | 1 | 99 |

*Using sorting threshold = 4.0 and above for good almonds
**Using sorting threshold = 3.6 and above for good almonds.

It can be seen that the present invention provides a method and apparatus for accurately and reliably sorting desired pieces of material from undesirable materials present in a mixture thereof, using near-infrared radiation absorbance measurement.

Since many modifications, variations and changes in detail may be made to the described embodiment, it is intended that all matter in the foregoing description and shown in the accompanying drawings be interpreted as illustrative and not in a limiting sense.

I claim:

1. A method for sorting desired pieces of agricultural materials from pieces of undesired material present in mixtures of desired agricultural material and undesired materials, comprising:

(a) irradiating a piece of material from a mixture of pieces of desired agricultural material and pieces of undesired material with a plurality of wavelengths of near-infrared radiation;

(b) measuring values for said plurality of wavelengths of near infrared radiation exiting said piece which are indicative of near-infrared radiation absorbed by said piece;

(c) sequentially comparing the measured values to a successive series of predetermined different absorption criteria in a predetermined order, which criteria distinguish the desired pieces of agricultural material from undesired pieces of material;

(d) rejecting the piece if it fails any one criterion in the sequence; and (e) accepting the piece if it passes all criteria in the sequence.

2. The method of claim 1, wherein each piece is simultaneously irradiated at each of said wavelengths.

3. The method of claim 1, wherein the pieces of material are singulated prior to being irradiated.

4. The method of claim 1, wherein after a piece fails a criterion it is not tested for a subsequent criteria.

5. An apparatus for sorting desired pieces of agricultural material from undesired pieces of material present in mixtures of desired agricultural material and undesired materials, comprising:

(a) means for irradiating a piece of material from a mixture of pieces of desired agricultural material and pieces of undesired material with a plurality of wavelengths of near-infrared radiation;

(b) means for measuring values for said plurality of wavelengths of near-infrared radiation exiting said piece which are indicative of near-infrared radiation absorbed by said piece;

(c) means for sequentially comparing the measured values to a successive series of predetermined different absorption criteria in a predetermined order, which criteria distinguish the desired pieces of agricultural material from undesired pieces of material;

(d) means for rejecting the piece if it fails any one criterion in the sequence or for accepting the piece if it passes all criteria in the sequence.

6. The apparatus of claim 5, wherein the irradiating means irradiates a piece simultaneously with each of said wavelengths.

7. The apparatus of claim 5, wherein the comparing means does not test a sample for subsequent criteria after a piece fails a criterion.

* * * * *

UNITED STATES PATENT AND TRADEMARK OFFICE

CERTIFICATE OF CORRECTION

PATENT NO. : 4,915,827

DATED : April 10, 1990

INVENTOR(S) : Robert D. ROSENTHAL

It is certified that error appears in the above-identified patent and that said Letters Patent is hereby corrected as shown below:

Column 3, Line 15, delete "storing" and substitute therefor --sorting--;

Signed and Sealed this

Fourth Day of February, 1992

*Attest:*

HARRY F. MANBECK, JR.

*Attesting Officer*

*Commissioner of Patents and Trademarks*